US009175484B2

(12) United States Patent
Fuegel

(10) Patent No.: US 9,175,484 B2
(45) Date of Patent: Nov. 3, 2015

(54) MOBILE CONCRETE PUMP

(71) Applicant: Putzmeister Engineering GmbH, Aichtal (DE)

(72) Inventor: Dietmar Fuegel, Wolfschlugen (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 14/394,184

(22) PCT Filed: Jul. 10, 2013

(86) PCT No.: PCT/EP2013/064552

§ 371 (c)(1),
(2) Date: Oct. 13, 2014

(87) PCT Pub. No.: WO2014/029552

PCT Pub. Date: Feb. 27, 2014

(65) Prior Publication Data

US 2015/0056084 A1 Feb. 26, 2015

(30) Foreign Application Priority Data

Aug. 24, 2012 (DE) ..... 10 2012 215 050

(51) Int. Cl.
*E04G 21/04* (2006.01)

(52) U.S. Cl.
CPC ..... *E04G 21/0436* (2013.01); *E04G 21/0445* (2013.01); *Y10T 137/6881* (2015.04); *Y10T 137/8807* (2015.04)

(58) Field of Classification Search
CPC ..... E04G 21/0436; E04G 21/0445; Y10T 37/6881; Y10T 37/8807
See application file for complete search history.

(56) References Cited

U.S. PATENT DOCUMENTS 6,276,718 B1 * 8/2001 Wolfram et al. ..... 280/765.1
6,516,917 B1 * 2/2003 Mayer et al. ..... 182/17
(Continued)

FOREIGN PATENT DOCUMENTS

DE 102 46 447 A1 4/2004
DE 20 2007 002 114 U1 5/2007
(Continued)

OTHER PUBLICATIONS

International Search Report of PCT/EP2013/064552, mailed Oct. 7, 2013.
(Continued)

*Primary Examiner* — Brodie Follman
(74) *Attorney, Agent, or Firm* — Collard & Roe, P.C.

(57) ABSTRACT

The invention relates to a mobile concrete pump comprising a supporting structure (46) that is placed directly or indirectly by means of an assembly frame (22) on the running gear (12) of an HGV chassis (10), the supporting structure incorporating functional units that form a support device and a placing boom (36). The placing boom (36) is rotatably mounted on a boom pedestal (44). The boom pedestal (44) comprises a vessel (52) that is inserted in the supporting structure (46) and acts as a rotary bearing for the placing boom (36), while the support device has two support leg casings (54, 56) which are integrated into the supporting structure (46), cross over one another, have diagonal passages that are open at the front and have a telescopic support leg (40) in each support leg casing. A feature of the invention is that the supporting structure (46) has a polygonal opening (50) which is open at the top and runs parallel to the rotational axis (48) of the placing boom (36), while the contour of the vessel (52) of the boom pedestal (44) is adapted to the polygonal opening (50) and the vessel is inserted from above into the polygonal opening (50) of the supporting structure (46). To achieve a particularly favorable flow of forces in this construction between the placing boom (36) and the support legs (40), each of two lateral faces (68) of the vessel (52) which form an angle to one another is aligned parallel with a respective lateral wall (70) of each support leg casing (54, 56).

9 Claims, 6 Drawing Sheets

(56) References Cited

U.S. PATENT DOCUMENTS

| | | | | |
|---|---|---|---|---|
| 6,799,778 | B2 * | 10/2004 | Heckmann | 280/763.1 |
| 6,811,161 | B1 * | 11/2004 | Anderson | 280/4 |
| 6,840,540 | B2 * | 1/2005 | Fugel | 280/763.1 |
| 7,654,800 | B2 * | 2/2010 | Leibbrand et al. | 417/234 |
| 8,282,130 | B2 * | 10/2012 | Fuegel | 280/765.1 |
| 8,302,993 | B2 * | 11/2012 | Wang et al. | 280/766.1 |
| 8,366,148 | B2 * | 2/2013 | Benz et al. | 280/763.1 |
| 8,794,670 | B2 * | 8/2014 | Fuegel | 280/763.1 |
| 2004/0197181 | A1 * | 10/2004 | Clark | 414/729 |
| 2006/0043718 | A1 * | 3/2006 | Mayer | 280/763.1 |
| 2011/0001309 | A1 * | 1/2011 | Wang et al. | 280/766.1 |
| 2011/0062695 | A1 * | 3/2011 | Bergemann et al. | 280/763.1 |
| 2014/0096853 | A1 * | 4/2014 | Neubert et al. | 137/615 |
| 2014/0246101 | A1 * | 9/2014 | Trumper et al. | 137/355.24 |
| 2015/0056084 | A1 * | 2/2015 | Fuegel | 417/234 |
| 2015/0176608 | A1 * | 6/2015 | Fuegel | 417/234 |

FOREIGN PATENT DOCUMENTS

| | | | |
|---|---|---|---|
| DE | 10 2007 001 913 | B4 | 7/2008 |
| DE | 20 2007 018 214 | U1 | 7/2008 |
| EP | 1 847 505 | A2 | 10/2007 |
| EP | 2 202 121 | A1 | 6/2010 |
| WO | 2006/040658 | A1 | 4/2006 |

OTHER PUBLICATIONS

German Search Report in German Application No. 10 2012 215 050.1, dated Mar. 4, 2013, with English translation of relevant parts.

* cited by examiner

MOBILE CONCRETE PUMP

CROSS REFERENCE TO RELATED APPLICATIONS

This application is the National Stage of PCT/EP2013/064552filed on Jul. 10, 2013, which claims priority under 35 U.S.C. §119 of German Application No. 10 2012 215 050.1 filed on Aug. 24, 2012, the disclosure of which is incorporated by reference. The international application under PCT article 21(2) was not published in English.

The invention relates to a mobile concrete pump with a carrying structure, capable of being placed directly or indirectly via a mounting frame onto a running gear of a motor truck chassis, for the accommodation of functional elements forming a supporting device and a distributor mast, the distributor mast being mounted rotatably on a mast trestle which comprises a shell inserted into the carrying structure and equipped as a rotary bearing for the distributor mast, and the supporting device comprising two mutually intersecting supporting leg boxes integrated in the carrying structure and open diagonally forward and in each case a supporting leg arranged telescopically in the supporting leg boxes.

In mobile concrete pumps of this type (DE 102 46 447 A1), the carrying structure is mounted onto a mounting frame and is placed together with this onto the running gear of a motor truck chassis. The carrying structure forms, with its mast trestle and the supporting leg boxes, the interface between the distributor mast and the supporting legs. The load moment caused by the distributor mast is in this case distributed to the supporting legs via the mast trestle and the supporting leg boxes and is introduced into the ground. In mobile concrete pumps, a carrying structure is especially popular which is equipped at the front with two telescopic supporting legs and at the rear with two outwardly pivotable supporting legs. In this design, the supporting leg boxes of the front supporting legs form an "X", that is to say they intersect one another diagonally in the carrying structure.

In terms of the introduction of forces, it would be ideal to have an intersection point of the two supporting leg boxes whereby the load moment of the distributor mast is introduced into the supporting legs over the shortest possible distance, that is to say if the shell were mounted as a carrier of the distributor mast at the intersection point. For technical reasons, however, in mobile concrete pumps it is mostly impossible to mount the shell at the intersection point, since in this case, because of the position of the center of gravity, the axle loads and the construction space necessary for the distributor mast, the shell will be positioned too far to the rear on the running gear. The shell is therefore usually seated in front of the supporting leg boxes in the direction of travel. However, the deflection of the force flux from the eccentric shell into the load-bearing vertical side walls of the support leg boxes is possible only at considerable outlay in structural terms. This design accordingly necessitates the use of heavy and structurally complicated mast trestles.

Proceeding from this, the object on which the invention is based is to configure the shell of the mast trestle and position it in the carrying structure such that, even in a lightweight type of construction, an optimal diversion of load from the distributor mast to the supporting legs is possible.

To achieve this object, the feature combination specified in patent claim 1 is proposed. Advantageous refinements and developments of the invention may be gathered from the dependent claims.

The solution according to the invention is based, above all, upon the notion that the carrying structure has an upwardly open polygonal orifice orientated parallel to the axis of rotation of the distributor mast, and that the shell of the mast trestle has a polygonal contour adapted to the polygonal orifice and is inserted into the polygonal orifice of the carrying structure. It is thereby possible that the shell is oriented with two of its side faces parallel to a side wall of one of the supporting leg boxes in each case. When the shell is thereupon integrated alignedly with two of its side faces into the respective side walls of the supporting leg boxes, an optimal introduction of force between the mast trestle and supporting leg boxes is achieved, along with a compact type of construction.

In a preferred refinement of the invention, the shell is flanged to the carrying structure and/or welded into this in the region of the polygonal orifice and of the supporting leg boxes. Advantageously, the shell forms a column composed of multiply bent sheet metal. Thus, two shell side faces and two side walls of the supporting leg boxes are thereby combined into one structural part. Admittedly, the force flux does not take place as directly via this common structure as if the shell were to be seated at the intersection point. However, as compared with currently conventional concrete pumps, the design according to the invention is largely deflection-free.

In a further advantageous refinement of the invention, the shell has in the region of its top edge a rotary drive connected operatively to the distributor mast. Further, expediently, the diagonally running supporting leg boxes are formed with two stories in such a way that they have telescopic tubes, arranged at different heights inside the carrying structure, for the supporting legs and free spaces separated from these by an intermediate floor. Advantageously, the shell of the mast trestle stands on the intermediate floor in the central region, a central orifice for the passage and/or rotary leadthrough of conveying, control and power lines being arranged in the intermediate floor.

For reasons of space, the polygonal orifice may have, on its side facing away from the supporting leg boxes, a marginal orifice through which the shell partially engages toward the end face. The intermediate floor carrying the shell has in this case expediently in the region of the central orifice a reinforcing zone formed as a result of bending deformation and/or by structural elements.

The invention is explained in more detail below by means of an exemplary embodiment illustrated diagrammatically in the drawing in which.

Figure 3:
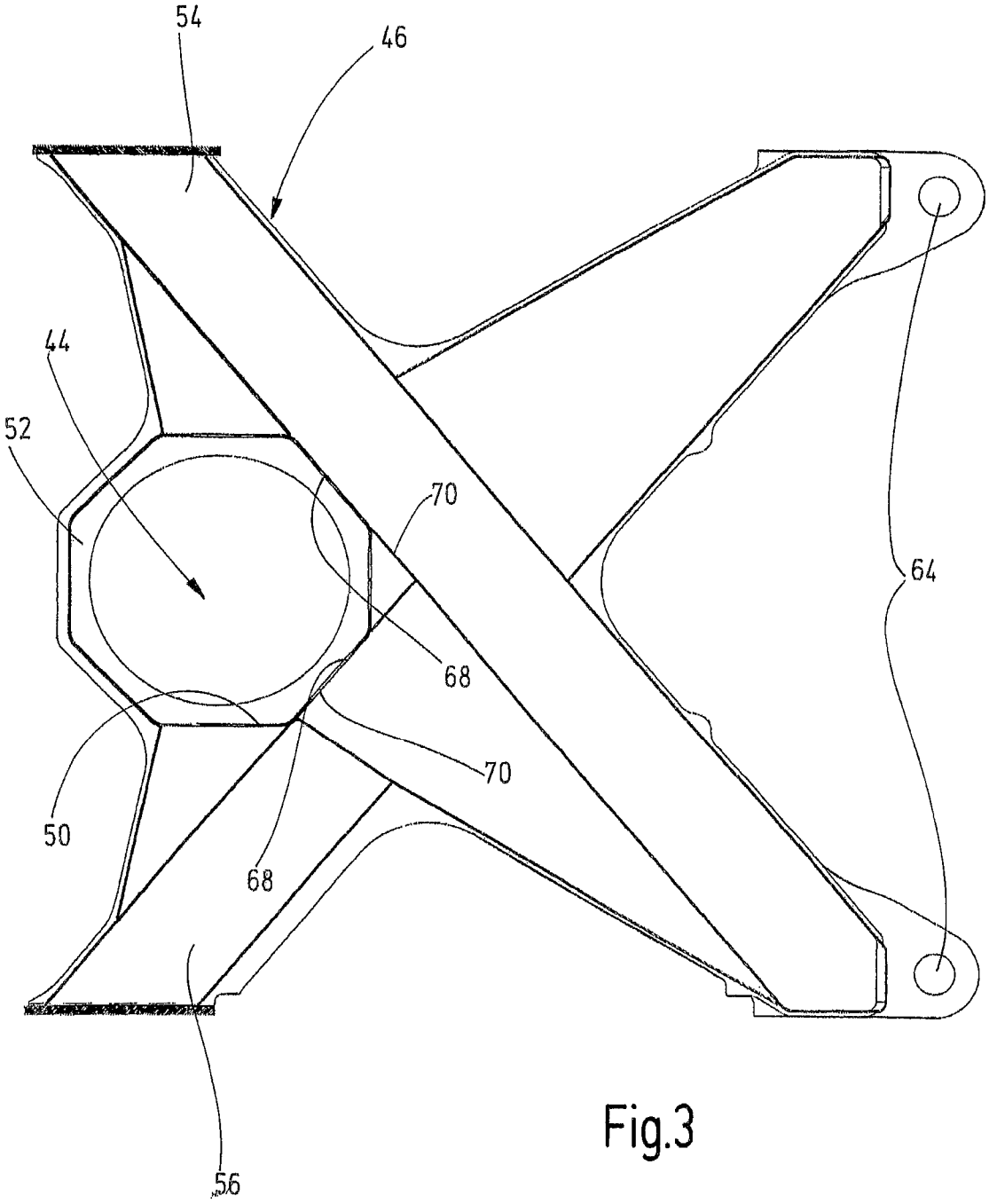
FIG. 3 shows a top view of the carrying structure of the concrete pump according to FIGS. 1 and 2 without a shell.
Figure 4A:
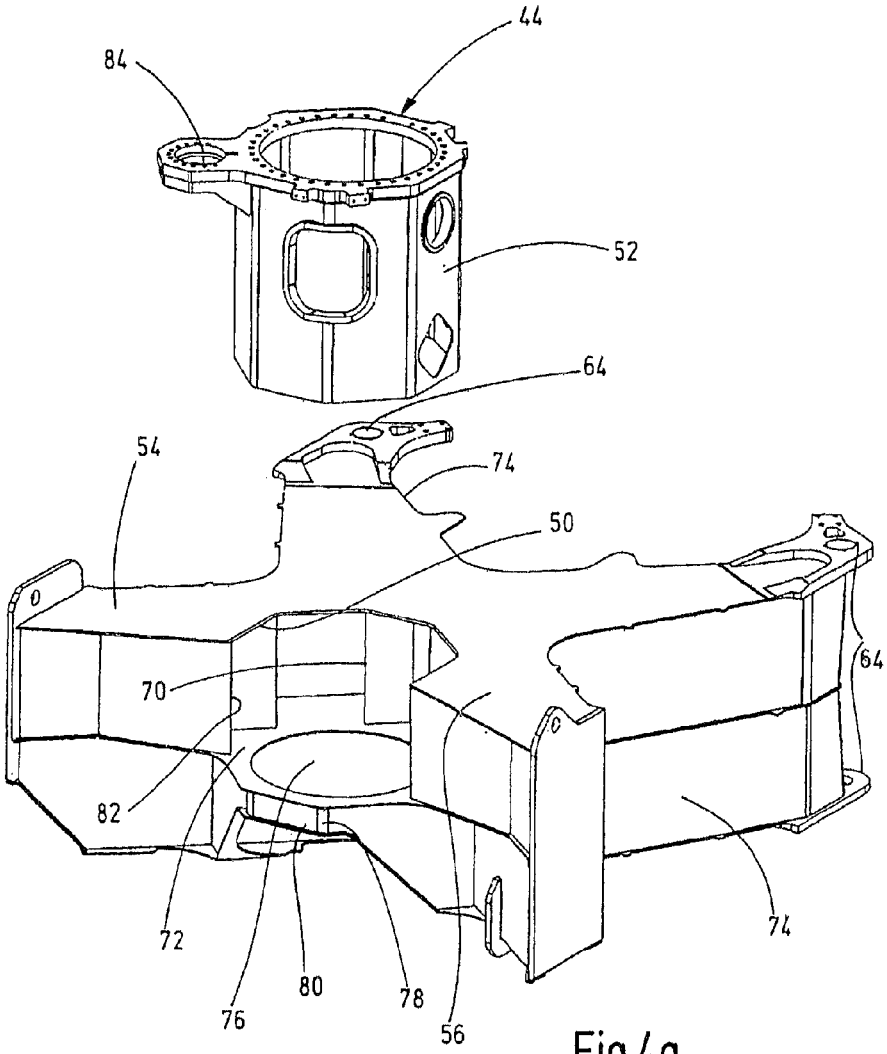
Figure 4B:
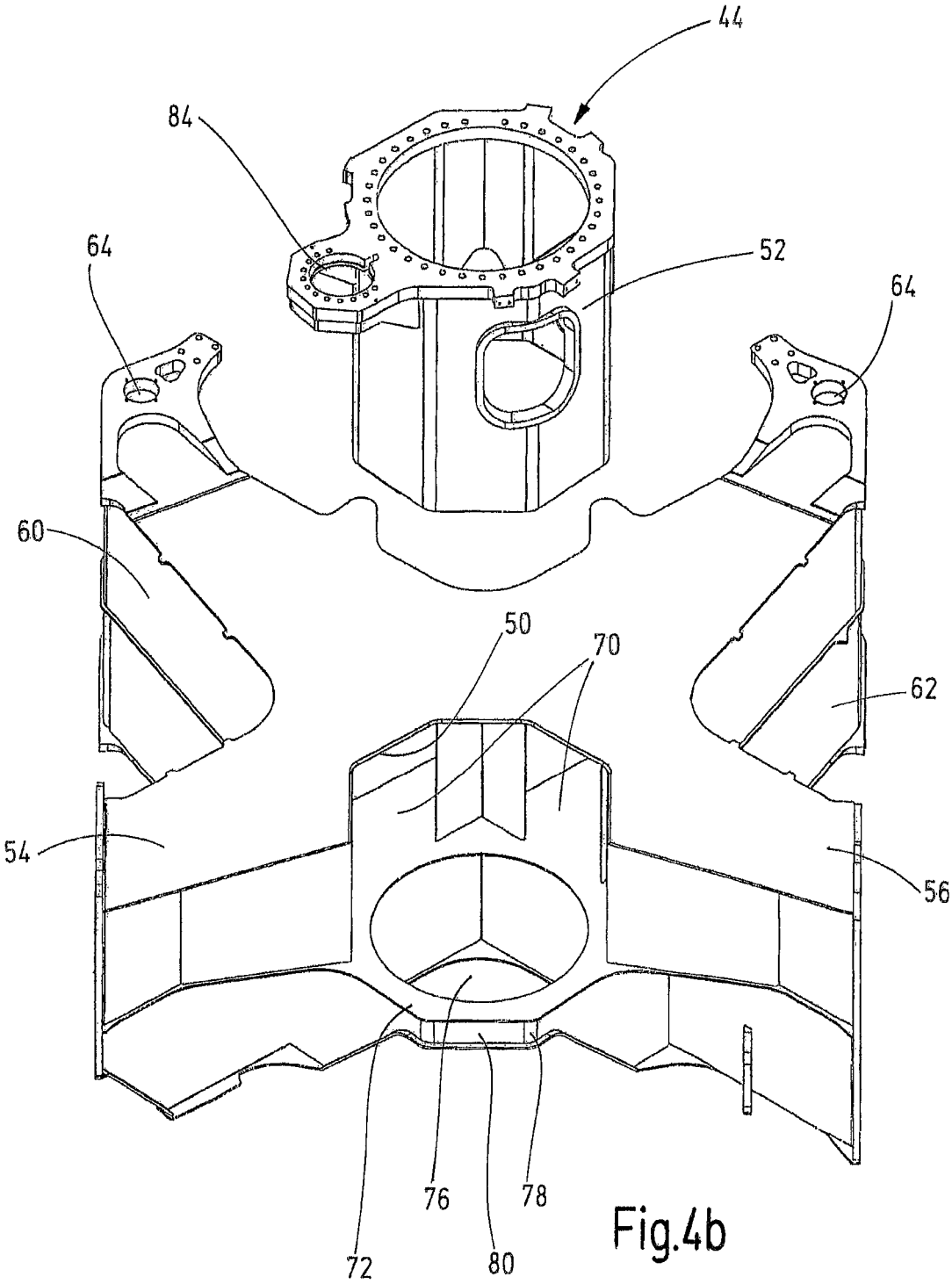
Figure 4C:
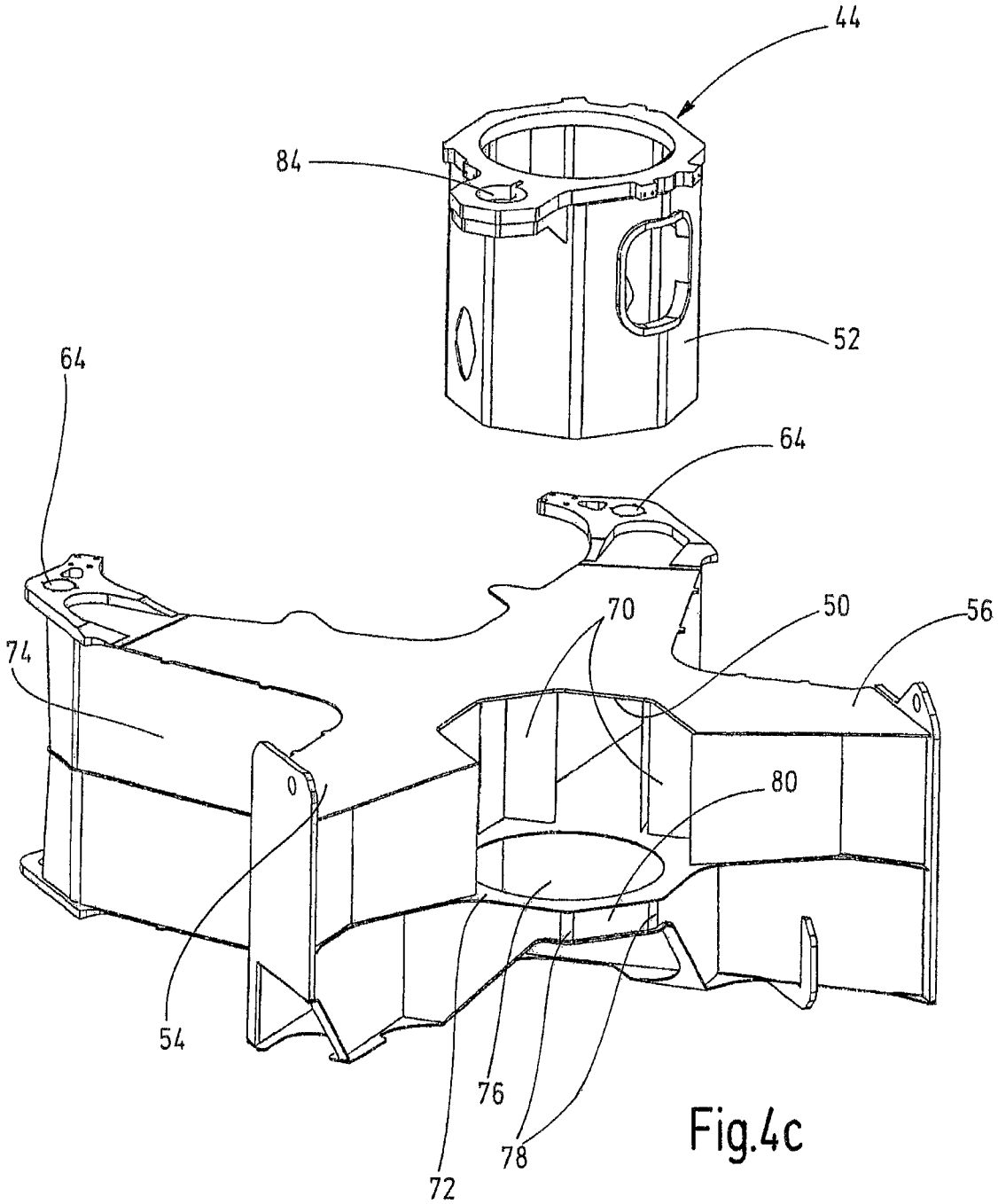

FIGS. 4*a* to *c* show three exploded diagrammatical illustrations of the carrying structure according to FIG. 3, with the shell lifted out.

Figure 1:
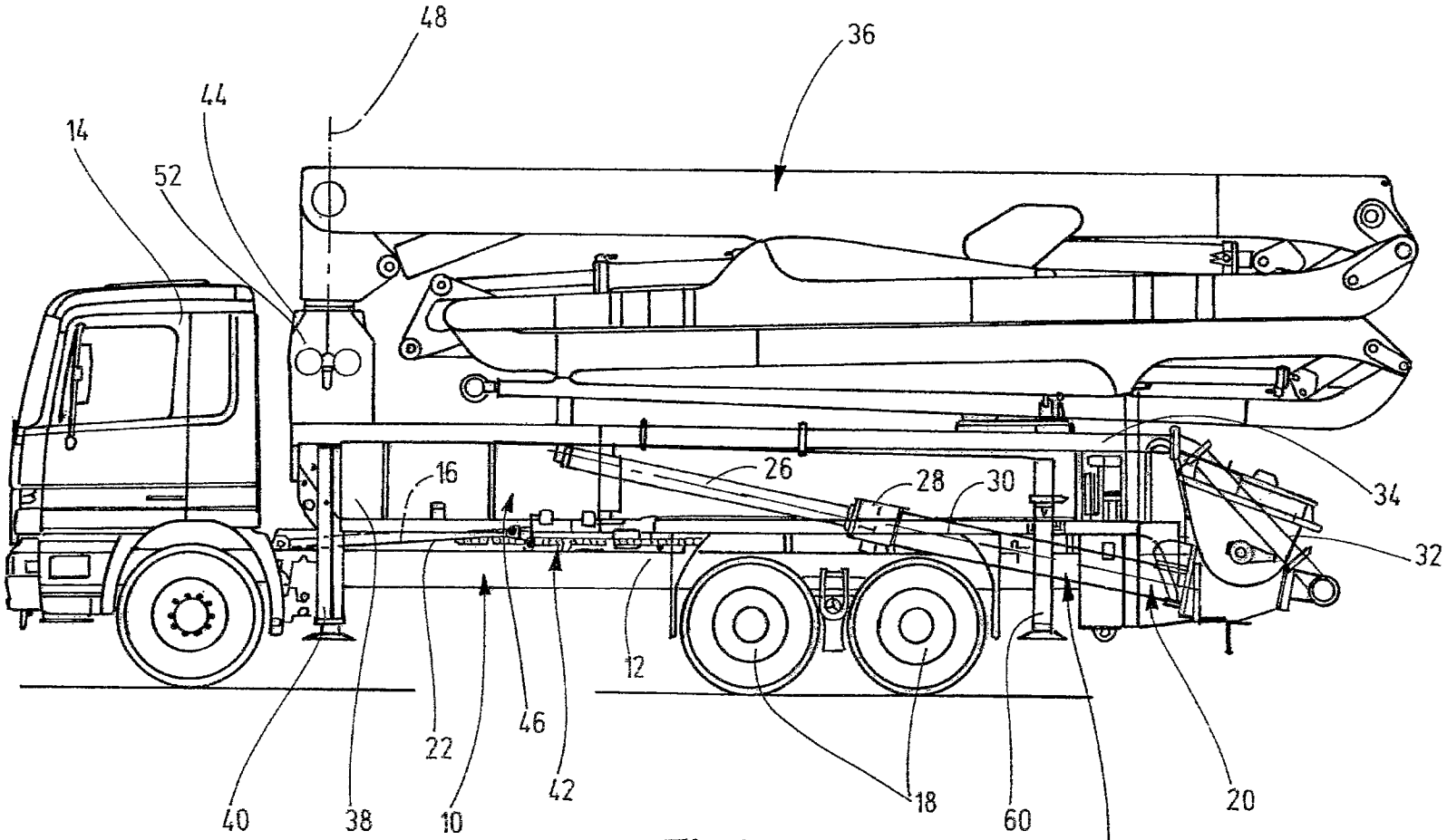
FIG. 1 shows a side view of a mobile concrete pump.
Figure 2:
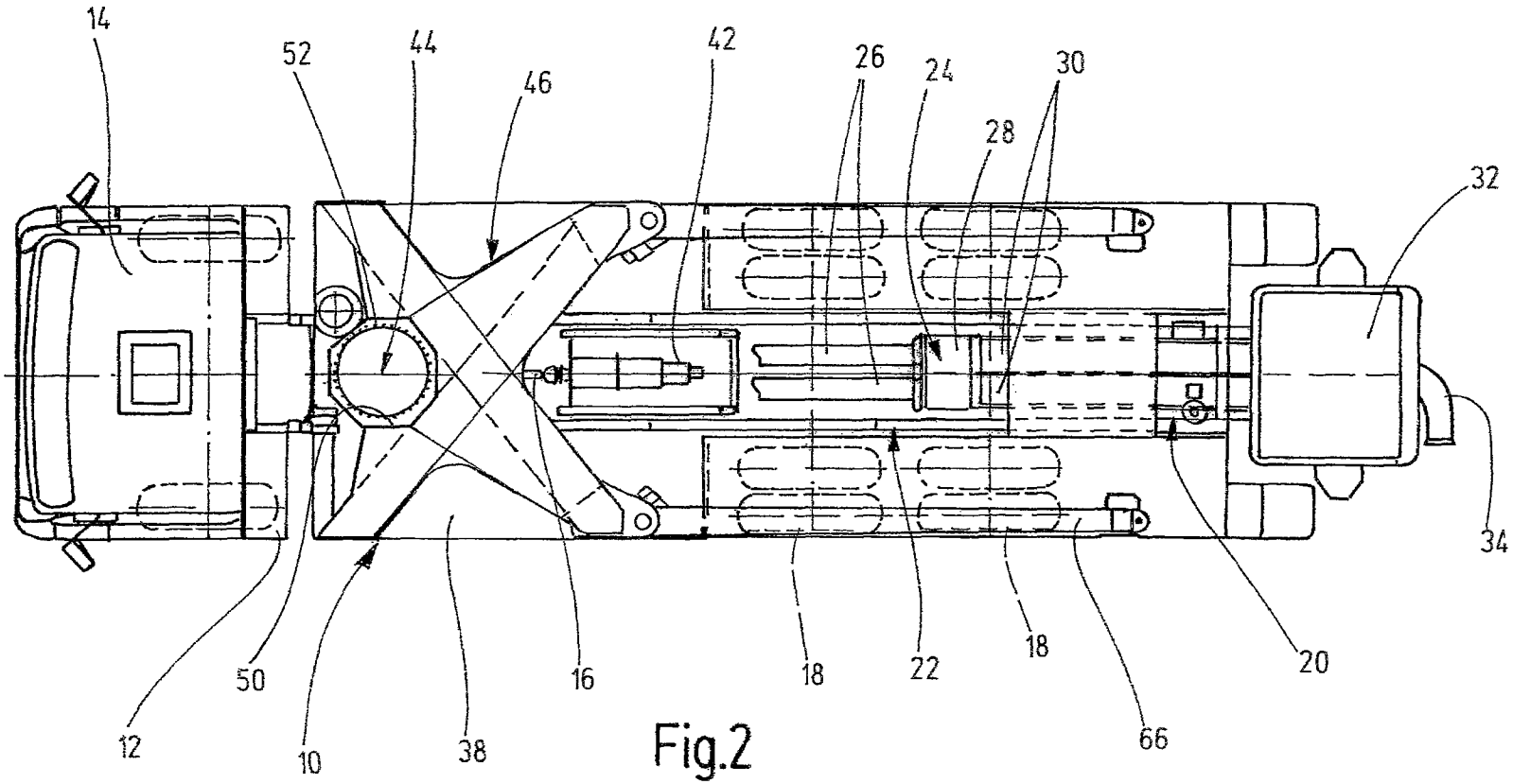
FIG. 2 shows a top view of the mobile concrete pump according to FIG. 1, with a distributor mast removed.

The mobile concrete pump shown in FIGS. 1 and 2 has a motor truck chassis 10 with an engine-driven running gear 12 and with a driver's cab 14, the engine drive of which can be coupled to the rear axles 18 via a drive train 16. The motor truck chassis 10 carries a concrete pump 20 which is connected to the running gear 12 via a mounting frame 22. The concrete pump set-up comprises essentially a core pump 24 with two hydraulic drive cylinders 26, with two conveying cylinders 30 connected in pairs to the drive cylinders 26 via a water box 28 and with a material feed container 32 arranged rigidly at the other end of the conveying cylinders 30. The set-up comprises, further, a pressure conveying line 34 which is guided via a distributor mast 36 designed as a collapsible mast and which has at the end of the last mast arm an end hose, not illustrated, which dispenses the conveyed concrete to the concreting location.

The distributor mast 36 is mounted rotatably about a vertical axis of rotation 48 on a mast trestle 44 connected rigidly in the vicinity of the far end to a carrying structure 46. In the exemplary embodiment shown, the mast trestle 44 has a shell 52 integrated in the carrying structure 46 and equipped as a rotary bearing for the distributor mast 36.

Further, a supporting device 38 with extendable supporting legs 40, 66 is provided. The supporting device comprises two supporting leg boxes 54, 56 which are integrated in the carrying structure 46 and which have in turn two telescopic tubes, open diagonally forward and intersecting one another at different heights, for the accommodation of the front supporting legs 40. Moreover, two rear supporting legs 66 pivotable outward laterally are articulated at the joints 64 at the rear end of the carrying structure 46. During concreting, the supporting legs 40, 66 are extended and, with the running gear 12 raised, are supported on the ground.

A particular feature of the invention is that the carrying structure 46 has an upwardly open polygonal orifice 50 oriented parallel to the axis of rotation 48 of the distributor mast 36, that the shell 52 of the mast trestle 44 has a polygonal contour adapted to the polygonal orifice 50 and is inserted from above into the polygonal orifice 50 of the carrying structure 46, and that the shell 52 is oriented with two side faces 68, forming an angle with one another, parallel to a side wall 70 of one of the supporting leg boxes 54, 56 in each case. As can be seen particularly from FIGS. 4*a* to *c*, the shell 52 forms a column composed of multiply bent sheet metal. It is inserted into the carrying structure 46 in the region of the polygonal orifice 50 such that it is integrated alignedly with two of its side faces 68 into a side wall 70 of one of the supporting leg boxes 54, 56 in each case. In order to achieve a rigid connection between the load-bearing parts of the shell 52 and the carrying structure 46, the shell 52 is welded into the carrying structure 46 in the region of the polygonal orifice 50 and of the supporting leg boxes 54, 56.

It can be seen, further, from FIGS. 4*a* to *c* that the diagonally running supporting leg boxes 54, 56 are formed with two stories in such a way that their telescopic tubes arranged at different heights inside the carrying structure 46 delimit free spaces 74 separated from these telescopic tubes by an intermediate floor 72. In the mounted state, the shell 52 of the mast trestle 44 stands on the intermediate floor 72. The intermediate floor 72 is provided there with a central orifice 76 for the passage and/or rotary leadthrough of conveying, control and power lines, not illustrated. In the region of the central orifice 76, the intermediate floor 72 has a reinforcing zone 80 which is formed as a result of bending deformation and by structural elements 78 and which absorbs the vertical load of the distributor mast 36 and deflects said load to the supporting legs 40, 66 via the carrying structure 46. Moreover, it can be seen from FIGS. 4*a* to *c* that the polygonal orifice 50 has, on its end face facing away from the supporting leg boxes 54, 56, a marginal orifice 82, through which the shell 52 partially engages. The shell 52 has in the region of its top edge a rotary drive which is connected operatively to the distributor mast and the bearing 84 of which can be seen in FIGS. 4*a* to *c*.

In summary, the following should be stated: the invention relates to a mobile concrete pump with a carrying structure 46, capable of being placed directly or indirectly via a mounting frame 22 onto a running gear 12 of a motor truck chassis 10, for the accommodation of a supporting device and functional units forming a distributor mast 36. A distributor mast 36 is mounted rotatably on a mast trestle 44. The mast trestle 44 comprises a shell 52 inserted into the carrying structure 46 and equipped as a rotary bearing for the distributor mast 36, while the supporting device has two mutually intersecting supporting leg boxes 54, 56 integrated in the carrying structure 46 and open diagonally forward and in each case a supporting leg 40 arranged telescopically in the supporting leg boxes. A particular feature of the invention is that the carrying structure 46 has an upwardly open polygonal orifice 50 oriented parallel to the axis of rotation 48 of the distributor mast 36, while the shell 52 of the mast trestle 44 has a polygonal contour adapted to the polygonal orifice 50 and is inserted from above into the polygonal orifice of the carrying structure 46. In this design, especially good force flux between the distributor mast 36 and the supporting legs 40 is achieved in that the shell 52 is oriented with two of its side faces 68, forming an angle with one another, parallel to a side wall 70 of one of the supporting leg boxes 54, 56 in each case.

List Of Reference Symbols

10 Motor truck chassis
12 Running gear
14 Driver's cab
16 Drive train
18 Rear axle
20 Concrete pump
22 Mounting frame
24 Core pump
26 Drive cylinder
28 Water box
30 Conveying cylinder
32 Material feed container
34 Pressure conveying line
36 Distributor mast
40, 66 Supporting legs
44 Mast trestle
46 Carrying structure
48 Axis of rotation
50 Polygonal orifice
52 Shell
54, 56 Supporting leg boxes
64 Joint
68 Side face shell
70 Side wall
72 Intermediate floor
74 Free spaces
76 Central orifice
78 Structural elements
80 Reinforcing zone
82 Marginal orifice
84 Bearing of the rotary drive

The invention claimed is:

1. A mobile concrete pump with a carrying structure (46), capable of being placed directly or indirectly via a mounting frame (22) onto a running gear (12) of a motor truck chassis (10), for the accommodation of functional units forming a supporting device and a distributor mast (36), the distributor mast (36) being mounted rotatably on a mast trestle (44) which comprises a shell (52) inserted into the carrying structure (46) and equipped as a rotary bearing for the distributor mast (36), and the supporting device comprising two mutually intersecting supporting leg boxes (54, 56) integrated in the carrying structure (46) and open diagonally forward and in each case a supporting leg (40) arranged telescopically in the supporting leg boxes (54, 56), wherein the carrying structure (46) has an upwardly open polygonal orifice (50) oriented parallel to the axis of rotation (48) of the distributor mast (36), wherein the shell (52) of the mast trestle (44) has a polygonal contour adapted to the polygonal orifice (50) and is inserted into the polygonal orifice (50) of the carrying structure (46), and wherein the shell (52) is oriented with two of its side faces (68) parallel to a side wall (70) of one of the supporting leg boxes (54, 56) in each case.

2. The concrete pump as claimed in claim 1, wherein the shell (52) is integrated alignedly with two of its side faces (68) into a side wall (70) of one of the supporting leg boxes (54, 56) in each case.

3. The concrete pump as claimed in claim 1, wherein the shell (52) is flanged to the carrying structure (46) and/or welded into this in the region of the polygonal orifice (50) and of the supporting leg boxes (54, 56).

4. The concrete pump as claimed in claim 1, wherein the shell (52) forms a column composed of multiply bent sheet metal.

5. The concrete pump as claimed in claim 1, wherein the shell (52) has in the region of its top edge a rotary drive connected operatively to the distributor mast (36).

6. The concrete pump as claimed in claim 1, wherein the diagonally running supporting leg boxes (54, 56) are formed with two stories in such a way that they have telescopic tubes, arranged at different heights inside the carrying structure (46), for the supporting legs and free spaces (74) separated from these telescopic tubes by an intermediate floor (72).

7. The concrete pump as claimed in claim 6, wherein the shell (52) of the mast trestle (44) stands on the intermediate floor (72), and wherein a central orifice (76) for the passage and/or rotary leadthrough of conveying, control and power lines is arranged in the intermediate floor (72).

8. The concrete pump as claimed in claim 1, wherein the polygonal orifice (50) has, on its side facing away from the supporting leg boxes (54, 56), a marginal orifice (82).

9. The concrete pump as claimed in claim 6, wherein the intermediate floor (72) has in the region of the central orifice (76) a reinforcing zone (80) formed as a result of bending deformation and/or by structural elements (78).

* * * * *